US006055408A

United States Patent [19]

Creutzmann et al.

[11] Patent Number: 6,055,408

[45] Date of Patent: Apr. 25, 2000

[54] DEVICE FOR THE POSITIONALLY EXACT SYNCHRONIZATION OF THE PARALLEL COURSE OF RECORDING MEDIUM WEBS IN AN ELECTROGRAPHIC PRINTER DEVICE

[75] Inventors: Edmund Creutzmann, Markt Schwaben; Andreas Eckardt, München; Walter Kopp, Taufkirchen; Hans Winter, München; Martin Silbersack, Markt Schwaben, all of Germany

[73] Assignee: Océ Printing Systems GmbH, Poing, Germany

[21] Appl. No.: 08/913,908

[22] PCT Filed: Oct. 30, 1995

[86] PCT No.: PCT/EP95/04265

§ 371 Date: Sep. 24, 1997

§ 102(e) Date: Sep. 24, 1997

[87] PCT Pub. No.: WO96/30812

PCT Pub. Date: Oct. 3, 1996

[30] Foreign Application Priority Data

Mar. 24, 1995 [EP] European Pat. Off. ..... 95104420

[51] Int. Cl.[7] ..... G03G 15/00

[52] U.S. Cl. ..... 399/384; 399/400

[58] Field of Search ..... 399/384, 388, 399/400, 397, 401; 226/25, 24, 44, 45

[56] References Cited

U.S. PATENT DOCUMENTS

| | | | |
|---|---|---|---|
| 4,987,448 | 1/1991 | Chikawa | 399/384 X |
| 5,060,025 | 10/1991 | Kummel et al. | 399/401 |
| 5,063,416 | 11/1991 | Honda et al. | 399/384 |
| 5,189,470 | 2/1993 | Matsuda et al. | 399/384 X |
| 5,546,178 | 8/1996 | Manzer et al. | 399/384 |
| 5,568,245 | 10/1996 | Ferber et al. | 399/384 |
| 5,659,875 | 8/1997 | Manzer et al. | 399/384 |
| 5,713,071 | 1/1998 | Hausmann | 399/384 X |
| 5,752,153 | 5/1998 | Kreiter et al. | 399/384 |
| 5,778,297 | 7/1998 | Reichl et al. | 399/384 |

FOREIGN PATENT DOCUMENTS

| | | |
|---|---|---|
| 58-024172 | 2/1983 | Japan . |
| 4-141473 | 5/1992 | Japan . |
| WO 91/11381 | 8/1991 | WIPO . |
| WO 94/09408 | 4/1994 | WIPO . |
| WO 94/27193 | 11/1994 | WIPO . |

OTHER PUBLICATIONS

Mayer, "Präzise gesteuerte Schrittmotoren ermöglichen Rückseitendruck", F&M Feinwerktechnik & Messtechnik, vol. 100, No. 8, Aug. 1992, Munich, pp. 339–343.

*Primary Examiner*—S. Lee
*Attorney, Agent, or Firm*—Hill & Simpson

[57] ABSTRACT

A printer for printing endless paper webs on both sides has two printing stations with a web turnover station therebetween. The paper web is fed in parallel side-by-side to the two printing stations which are on the same rollers. The drive of the web through the printer is by a positive drive, using pins to engage holes in the paper web, for example, into the first printing station. The drive of the paper web thereafter is by friction drive to permit slippage in the drive to compensate for variations in paper length during heating, etc. The slippage is controlled by brakes or other drag inducing devices acting on one or both of the two portions of the paper web.

20 Claims, 10 Drawing Sheets

SCHEMATIC DIAGRAM OF THE PAPER COURSE

DEVICE FOR THE POSITIONALLY EXACT SYNCHRONIZATION OF THE PARALLEL COURSE OF RECORDING MEDIUM WEBS IN AN ELECTROGRAPHIC PRINTER DEVICE

BACKGROUND OF THE INVENTION

1. Field of the Invention

The present invention is directed to a device for the positionally exact synchronization of the parallel course of recording medium webs in an electrographic printer device.

2. Description of the Related Art

An electrographic printer device wherein two recording medium webs arranged parallel are simultaneously moved through the printer and printed is disclosed, for example, by published International Patent application WO 94/27193. In such a printer device and other paper-processing systems wherein two parallel paper webs pass through successive function units with friction or positive drive, the drive of the paper webs is a particular problem. In order to avoid malfunctions, thus, a parallel, synchronous paper course must be guaranteed.

DESCRIPTION OF THE PROBLEM

Generalities

The following is to be noted or, respectively, the following problems generally occur when synchronously conveying a paper web through a plurality of function units of a printer device: In order to achieve a prescribed registration precision, the printing format must be aligned relative to the paper form when printing.

Tensile forces occur in the web upon passage of the web through the printer. These are partly unavoidable, for example due to friction. On the other hand, tensile forces are intentionally introduced into the web in order to stabilize the paper running.

The tensile forces in the paper vary during printing.

The drives drive the web opposite the influence of the tensile forces (described below).

The paper web shrinks when it is heated, namely dependent on the paper grade (which determines, for example, the water content) and the extent of heating. Upon passage through a standard type thermal fixing station, for example, the shrinkage in the web direction lies on the order of magnitude of 0.06%.

The advance feed holes of the paper webs are subject to manufacturing tolerances. These amount to up to 0.12% of the rated dimension.

DISCUSSION OF THE VARIOUS OPERATING MODES

Different conveying principles are applied for driving the paper webs, for example in continuous printers. These are:

Friction Drive

The drive of the paper webs by friction usually ensues in roller nips or via friction roller drives. What is thereby particularly critical is the drive in the roller nip (in other words, the fixing gap) between the fixing and pressure rollers of a thermal pressure fixing station.

A friction drive conveys a web length per a time interval. However, the slippage, which occurs on principle in any friction drive, varies dependent on force and friction relationships. Slippage means that there is no fixed transmission ratio between the driving part and the driven part, and the driven part lags behind the driving part to a greater or lesser extent. Given drive in the roller nip of, for example, a fixing station, the paper web is slower by the slippage than the surface speed of the drive roller. Given a constant drive motor speed, thus, the speed of the driven paper web changes due to influences of force and friction.

Positive Drive

The drive of paper webs by positive lock usually ensues via paper-conveying caterpillars or pin wheels that engage into advance feed holes of the paper. What is meant here by a positive drive is also a drive that is in fact a friction drive in mechanical terms but is controlled, for example, by electronic means to the conveying of form elements. Such a drive, accordingly, automatically compensates for differing slippage and behaves like a positive drive with respect to the web speed. Form elements are repeating, detectable features involving the paper web. These, for example, can be: advance feed holes, printing marks, folds, perforations, or labels.

A positive drive conveys a defined plurality of form elements (for example, links of a chain, or advance feed holes in the paper web) per time interval. Due to various influences, the advance feed holes can have different spacings from one another (due to perforation tolerances, or paper shrinkage). Tolerances in the hole spacing below an allowable limit do not influence the function of the drive. The tolerances occurring here are on the order of magnitude of up to 0.2%. When conveying a specific plurality of advance feed holes, a respectively different web length is thereby conveyed.

Given a constant drive motor speed, thus, the speed of the driven paper web varies due to perforation tolerances and temperature influences. In electrographic printer devices that work with continuous stock, the form position is permanently defined relative to the advance feed holes. The form synchronization is thus usually accomplished via the advance feed holes and a positive drive. The alignment of the printing format relative to the paper form in turn usually ensues via the form elements in a positive drive.

A defined, constant paper speed can thus not be achieved with either of the two drive types solely by keeping the motor speed constant.

Two Drives in Sequence

When, in a paper-processing system, a plurality of drives are sequentially employed along a web, a corresponding synchronization must ensue dependent on the nature of the drives. FIGS. 1 through 3 shows several possibilities of the series circuit of web drives. The elements shown as brakes symbolically illustrate the creation of the tensile forces in the paper. M is the drive moment of the respective drive, n being the drive speed.

Two Positive Drives in Sequence (see FIG. 1)

When, given the series connection of two positive drives, the two drives (speeds) are rigidly coupled to one another, the content of the web store lying therebetween does not change summarily. When an advance feed hole is supplied from the $\mathbf{1}^{st}$ drive, an advance feed hole is drawn off from the $\mathbf{2}^{nd}$ drive. The sum of advance feed holes between the drives remains the same. No regulation of the web length between drive 1 and 2 is thus required. The fixed coupling of drive 1 and 2 can ensue both mechanically (for example, via a fixed shaft connection or a gearing arrangement) as well as electronically (for example, by employing two stepping motors operating by the same clock signal). However, the web speed, which changes with the perforation tolerance, is affected by tolerances given this drive system.

Two Friction Drives in Sequence (see FIG. 2)

The coupling of the drives here does not assure disruption-free running of the paper web. Dependent on the extent of the slippage of drives 1 and 2, a difference in drive speed will thus arise in the running paper. This means a general error for the web store between the two drives. The web store is thus either emptied and the paper tears or it overflows. A regulation of the web length between the two drives must thus ensue here. The regulation is usually implemented as a regulation of the drive speed of at least one of the two drives. Whereby the content of the web store is kept at a constant value with the regulation of the drive speed.

Two Different Drives in Sequence (see FIG. 3)

When two different drives are utilized in series, a control of the web length between the two drives must again ensue. A coupling of the drives is inadequate since the web speed in the positive drive fluctuates with the perforation tolerance and fluctuates with the tensile forces in the friction drive. These fluctuations do not compensate each other; a general error with the afore-mentioned consequences arises for the web store.

Two Webs Synchronously Parallel

Given the problem described here, two paper webs are processed synchronously in parallel. This is the case given: two completely independent webs that pass through the printer in parallel side-by-side overall or in sub-sections; one web that is returned in a loop and again traverses in parallel drives after the return. (See FIG. 4).

What parallel means is that the webs runs next to one another, namely through the same divided or undivided aggregates or function units. What synchronous means is that no shift occurs between the forms of the one web and the forms of the other web when the paper is running. In the present case, the leading edge of the forms is the same in both webs when the alignment line has been reached. Here, the alignment line coincides with the line in which the paper is printed. In order to guarantee the synchronism, a common positive drive is utilized here. The A-web and B-web emerge in parallel from the coupled positive drive. Due to differences in the advance feed holes, the paper web speeds of web A and web B are different even though the exiting hole frequency is the same.

In the illustrated case of FIG. 4, the A-web runs through the fixing roller pair after the caterpillar drive. The fixing roller pair is a friction drive, on the one hand; on the other hand, the printing format is fixed to the paper here by hot rollers. The paper web shrinks in the longitudinal direction given this heating. The spacing of the advance feed holes thus shortens by, for example, approximately 0.6%. The A-web is in turn returned following the fixing rollers and then runs through the caterpillar drive as the B-web in parallel to the new A-web. It follows therefrom that the B-web now runs slower than the A-web by that 0.06% shrinkage.

The problem thereby deriving is to process the two webs having different speeds with an undivided pair of fixing rollers wherein the surface speed of the drive friction roller cannot be differentiated for the two webs.

A regulation of the drive speed as initially described is not adequate here by itself since only one web can be regulated thereover between two drives.

It must be additionally guaranteed in the illustrated arrangement of FIG. 4 that the paper length does not summarily change in the return loop between the A-web and B-web.

The synchronization of successive conveyor units for a single web in a web-processing system, which is for example a continuous printer, can ensues via a band store, for example a loop-forming unit. The conveyor speeds of the adjoining drives are thereby regulated dependent on the storage content thereof. For the described reasons, such a synchronization is not possible given a parallel-synchronous operation of two webs.

SUMMARY OF THE INVENTION

It is therefore an object of the present invention to provide a device for the positionally exact synchronization of the parallel course of recording medium webs in an electrographic printer device, whereby the recording medium webs pass through a first function region in parallel side-by-side positively driven via a drive means and are then supplied in parallel side by-side to a second function region with a friction drive.

A further goal of the invention is also to fashion the device such that, in particular, it enables a simple and dependable regulation of the parallel course of the recording medium webs in a electrographic printer device as disclosed by the published International Patent application WO 94/27193.

These goals are fundamentally achieved by a control means that regulates the parallel running by controlling the slippage of the friction drive.

Advantageous embodiments of the invention are provided by a device as described above whereby respective loop tractors with sensors acquiring their swivelled position are allocated to the recording medium webs. Loop-forming units that are fashioned such that they deflect the recording medium webs with an adjustable deflection force dependent on their rotated position are provided. The loop-forming units comprise a deflection element with appertaining deflection spring that engage at the recording medium webs and are pivotable around a rotational axis, whereby the deflection spring is coupled to a tensing means for setting the spring prestress.

As a further improvement, the above device has the regulating means comprising a first function group that controls the content of the band store that, for example by varying the speed of the friction drive, influences the content of the band stores of the recording medium webs in the same sense, and also comprises a second function group that controls the difference of the store contents of the band stores that, for example by varying the tensing force in the respective recording medium web, oppositely influences the content of the band stores.

Sensors for sensing markings on the recording medium webs may be provided.

A brake that is arranged preceding the friction drive in the recording medium conveying direction and whose braking power on the recording medium web or webs can be regulated. The brake has a glide surface comprising suction openings accepting the recording medium webs which is allocated to each of the recording medium webs, the glide surface being coupled to a means generating an adjustable underpressure.

The device of one embodiment has a transfer printing region, a transfer printing station as the first function region and a fixing station as the second function region.

The device of a preferred embodiment has a second function region that comprises a fixing drum with an appertaining pressure roller that presses the recording medium against the fixing drum, whereby at least one of the rollers is heated and motor-driven. A controllable device for setting the pressing power on the recording medium webs is provided. This has a movably seated pressure roller pressing the recording medium webs against a drive roller of the friction drive and having a force adjustment mechanism coupled to the pressure roller in order to web-specifically vary the pressing power of the pressure roller in the region of the recording medium webs in one embodiment. Spring elements that are coupled to a setting means and to a respective lateral bearing element of the pressure roller such that they press the pressure roller in force-compensating fashion against the cooperating roller in a zero position of the setting means are preferred, whereby an transmission of force to the bearing elements that is dependent on setting position then ensues by excursion of the setting means out of the zero position.

A means for the controllable variation of the coefficient of friction of the rollers may be provided. The variation of the coefficient of friction ensues by controlled delivery of parting oil.

The device described above has a fixing station that is fashioned as a flash fixing means in one printer embodiment. The fixing station is fashioned as a projector fixing means in another.

The invention provides that the device has means allocated to the regulating means via which a synchronization stop is triggered given upward transgression of a predetermined range of control, during which synchronization stop a synchronization of the parallel running of the recording medium webs can ensue by relative displacement of the recording medium webs into a synchronous position.

An application of the transport system described is arranged in an electrographic printer device for single-sided or both-sided printing of a band-shaped recording medium, whereby the printer device comprises:

an intermediate carrier for generating toner images allocated to the front side and/or the back side of the recording medium;

a transfer printing station having a first transfer printing region for the transfer of a first toner image onto a front side region of the recording medium and a second transfer printing region lying there next to for the transfer of a further toner image onto the front side region or a back side region of the recording medium, as well as a conveyor means that positively drives the recording medium in the transfer printing regions;

a fixing station following the transfer printing station in conveying direction of the recording medium having an allocated friction drive for the recording medium, whereby the recording medium, in a first recording medium web proceeding from a delivery region, is conducted via the first transfer printing region to the fixing station and, turned over by a turning means as needed for printing the bask side region, is conducted therefrom to the second transfer printing region and is conducted again through the fixing station in a second recording medium web.

The invention also provides a method for producing a disruption-free running of recording medium webs in an electrographic printer device, whereby the recording medium webs, positively driven in common via a drive means, pass through a first function region in parallel side-by-side and are then supplied in parallel side-by-side to a second function region with common a friction drive, whereby the surface speed of the surface of the friction drive driving the webs cannot be differentiated for the webs, comprising the following steps:

acquiring the relative displacement in the conveying direction of the recording medium webs relative to one another in a region between the transfer printing region and the fixing station;

controlling the slippage of the friction drive in the conveying direction of each individual recording medium web until the relative displacement falls below a prescribable value.

By collective and web-specific control, the size of the occurring slippage of each individual paper web is regulated such in the friction drive that a disruption-free paper running is guaranteed. To this end, the control can—during and outside of the printing mode—influence:

the speed of the friction drive, the paper-tensing forces of the individual paper webs, the surface pressing in the nip of the friction drive, the coefficient of friction of the friction roller (via the lubrication thereof).

It also serves for:

controlling events during paper insertion, start and stop, acquiring errors of the machine and of the paper running.

Each web has a web store between the positive drive and the friction drive, this also being referred to as band store. Therein, a respective loop-drawing unit tenses the paper web and measures the content of the web store (i.e. the length of the paper loop).

The control is divided into two function groups that are largely independent of one another:

The Loop Length Control

The loop length control acts in the same sense on both paper loops. The main instrument of this control is the speed of the friction roller (which is the fixing drum).

The Loop Difference Control

The loop difference control acts oppositely on the two paper loops. Here, the main instrument is the web-specific tension in the respective paper web.

The basic procedure of the control is to keep the paper loop length, i.e. the storage content of the band stores, within allowed limits.

Such a control via the slippage is unusual, particularly given the employment of a friction drive in a fixing station, since a slippage usually results in a smearing of the toner image, which is precisely what should be avoided.

BRIEF DESCRIPTION OF THE DRAWINGS

Embodiments of the invention are shown in the drawings and are described in greater detail below with reference to the drawings by way of example. Shown are.

DETAILED DESCRIPTION OF THE PREFERRED EMBODIMENTS

Figure 1:
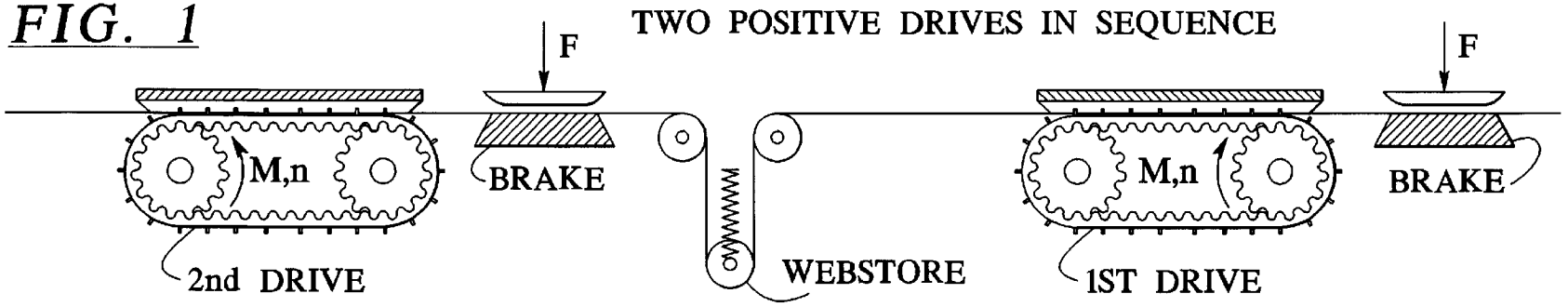
FIG. 1 is a schematic illustration of a recording medium web with two positive drives in series.
Figure 2:
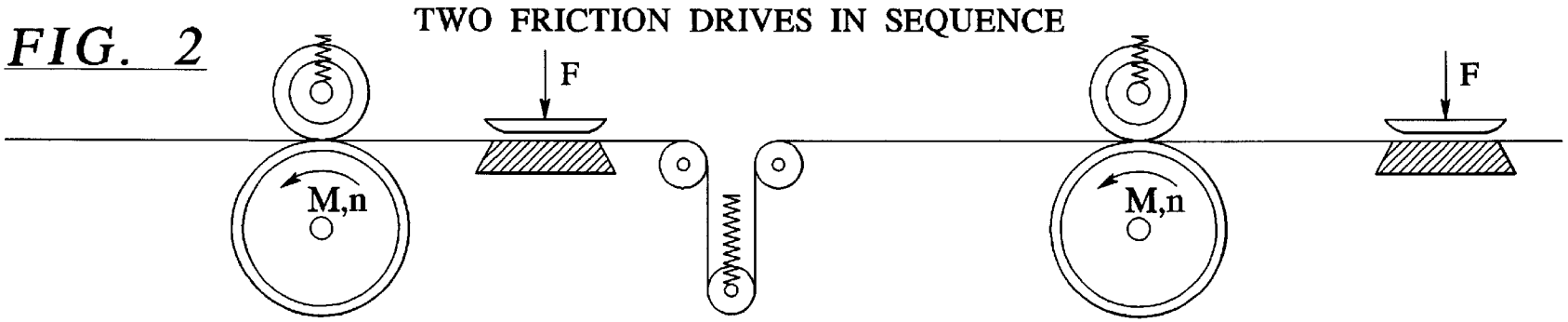
FIG. 2 is a schematic illustration of a recording medium web with two friction drives in series.
Figure 3:
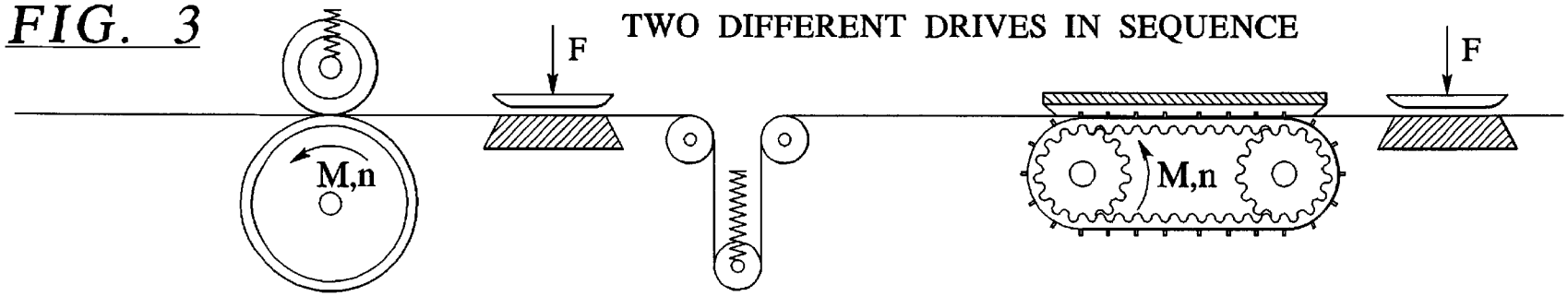
FIG. 3 is a schematic illustration of a recording medium web with two different drives in series.
Figure 4:
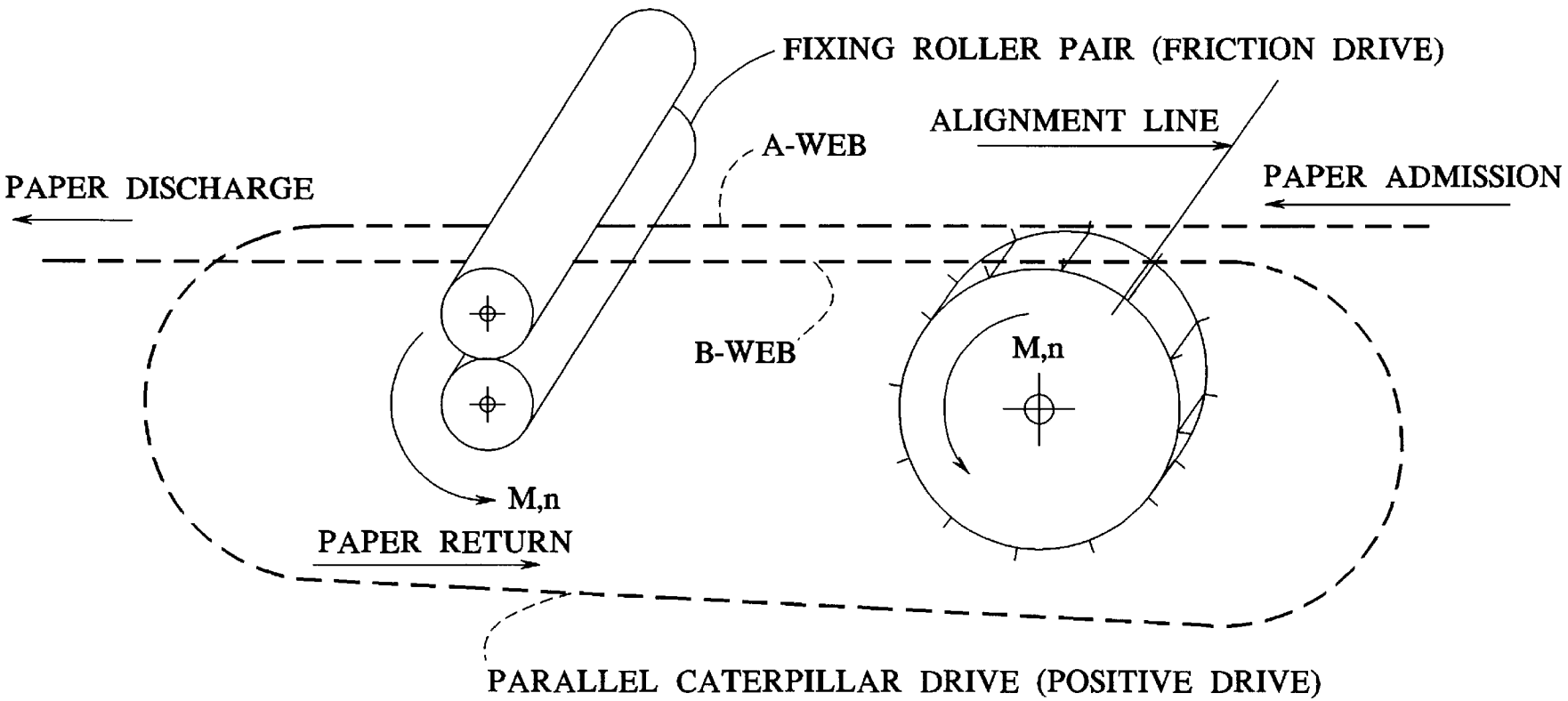
FIG. 4 is a schematic illustration of the paper course in a printer device with two recording medium webs running in parallel.
Figure 5:
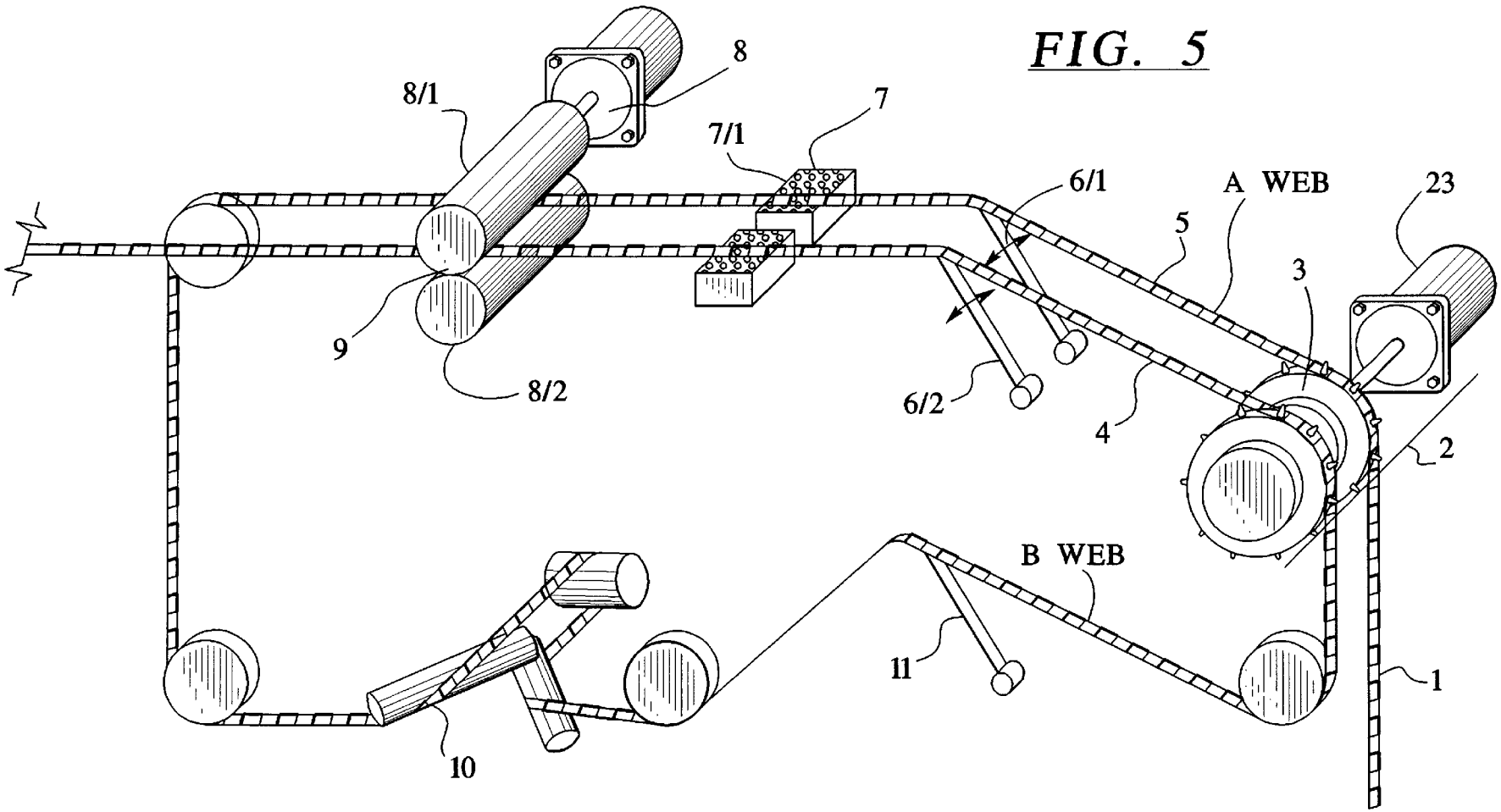
FIG. 5 is a schematic illustration of the paper course in a printer device with duplex printing on a single paper web with two recording medium webs running in parallel.

The invention is described below on the basis of the structure of an electrographic printer device for one-sided or both-sided printing of a band-shaped recording medium as disclosed by the published International Patent application WO 94/27193. The content of this publication is incorporated herein as part of the disclosure of the present application. Paper course in an electrographic printer device with return of the recording medium and a parallel running control According to the illustration of FIG. 5, the band-shaped recording medium 1 in the inventive printer device is drawn into the printer by, for example, a roller proceeding from a delivery region and, in the region of the alignment line 2, is printed with toner images allocated to the front side. The recording medium 1 is thereby fashioned as continuous fanfold stock. The transfer printing region for the transfer-printing of the toner images from an intermediate carrier (such as a photoconductive drum) onto the recording medium 1 having a structure according to the application WO 94/27193 is located in the region of the alignment line 2. The drive 3 in the transfer printing region ensues positively via tractors with nipples or pegs arranged thereon that engage into corresponding margin perforations (shown as white voids) of the recording medium 1. For distinguishing the web that is newly drawn in and allocated to the front side in the transfer printing region (alignment line 2), let the "front side web" be called A-web (reference character 5) and the "back side web" be called B-web (reference character 4). The A-web 5 passes a band store in the form of a loop tractor 6/1 and is driven by a friction drive 8 in the form of a fixing station via an underpressure brake 7/1. Subsequently, the web is returned, turned over in a turning means 10 and resupplied as the B-web 4 to the positive drive 3 in parallel to the web that is newly drawn in. When passing the alignment line 2, the back side is printed in the transfer printing region in parallel to and synchronously with the A-web. The B-web, further, runs parallel to the A-web over a loop tractor 6/2, an underpressure brake 7/2 and through the friction drive 8 of the fixing station again. Subsequently, it is supplied to a paper output, for example a stacker, or some other paper post-processing means.

A band store 11 in the form of a loop tractor is arranged between the return of the A-web and the redelivery of the web into the positive drive 3 as the B-web, being arranged following the turning means 10 in the paper conveying direction. In the arrangement described here, this loop corresponds to the web store between two positive drives whose function was initially described. The stored content of the loop, thus, does not summarily change without regulation. The store is merely needed to compensate for tolerances and for forms synchronization given insertion of forms having different lengths.

The friction drive 8 is formed in the printer by the fixing drum 8/1 and pressure roller 8/2 and has the job of fixing the toner images on the recording medium 1. The driven fixing drum 8/1 is therefore heated. The entrained pressure roller 8/2 is pressed against the fixing drum. The paper web is pressed, heated and driven in a fixing gap 9 between the two rollers. The web thereby shrinks in a longitudinal and a transverse direction due to loss of moisture. This means that the spacings between the form elements (such as forms, or perforation holes) become smaller. It follows therefrom that, after the return, the B-web exits the positive drive 3 with a lower web speed than the A-web.

Elements of the Regulating Means

Figure 6:
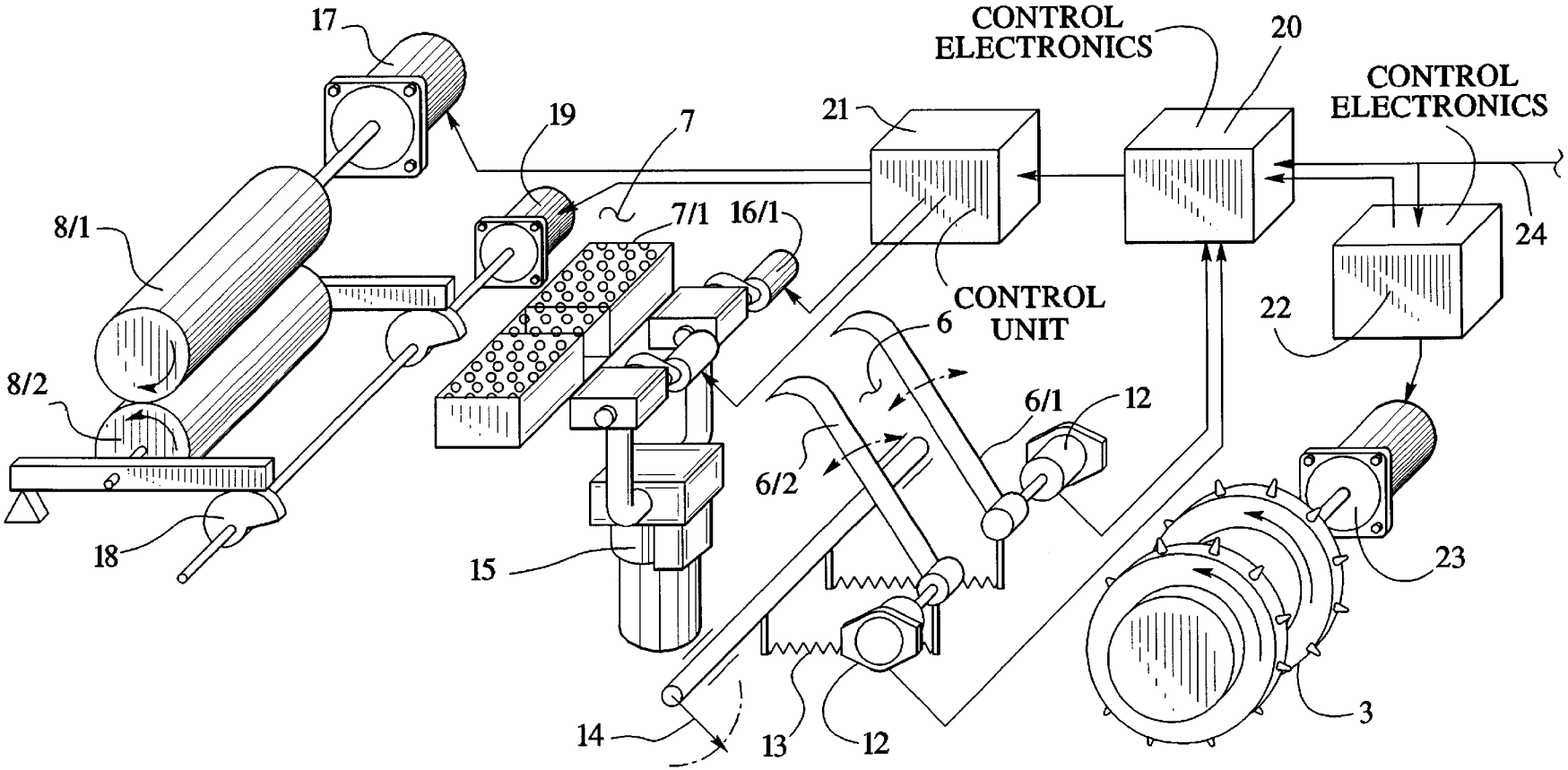
FIG. 6 is a schematic illustration of the structure of a printer device with duplex printing according to FIG. 5 with a control means for the synchronization of the recording medium webs running in parallel.

The regulating means for the positionally exact synchronization of the parallel running of the recording medium webs 4, 5 can, according to the illustration of FIG. 6, be subdivided into the following assemblies.

Loop Tractor Assembly

It is composed of the loop-drawing unit 6 composed of two loop tractors 6/1, 6/2 allocated to the respective web 4 and 5 that each comprises a loop tractor angle sensor 12, a spring mechanism 13 for the loop tractor 7 and an adjustment means 14 for the loop tractor torque. A means for coupling the two loop tractors is not shown.

Function Region: Underpressure Brake

It is composed of a means 15 for generating underpressure, for example a suction pump, that is in communication with an underpressure valve and a control assembly 16 composed of two separately controllable valves 16/1, 16/2 and that is coupled to the actual underpressure brake 7 composed of two separate glide surfaces 7/1, 7/2 with suction holes.

Fixing Region

It is composed of the fixing drum 8/1, a drive 17 in the form of an electric motor for the fixing drum 8/1, of the pressure roller 8/2 as well as a pivoting mechanism 18 for the pressure roller 8/2 composed of two cams coupled with a drive 19 via a rotational axis that engage at the shaft of the pressure roller 8/2 via lever elements.

Electronics

Included here is the actual control electronics 20 composed a microprocessor-controlled arrangement constructed in the usual way that is in communication via bus lines with a power electronics 21 for the drive of the fixing station, the drive 19 of the pressure roller and the valves 16/1, 16/2 of the brake and is also in communication via a bus line with a control electronics 22 constructed in the usual way for a drive of the positive drive 3 (or caterpillar) of the transfer printing station. The control electronics 20 is also coupled via lines with the rotational angle sensors 12 of the loop tractors 6 and is in communication via a bus line 24 with the device controller of the printer. The structure thereof is known from the published application WO 94/27193.

Input quantities for the control are supplied to the control electronics 20 via the bus or control lines 24 from the surroundings (for example, the device controller) and, via the control 22, from the drive 23 of the conveyor caterpillars in the transfer printing station.

Various Embodiments of the Loop Tractor

Figure 8:
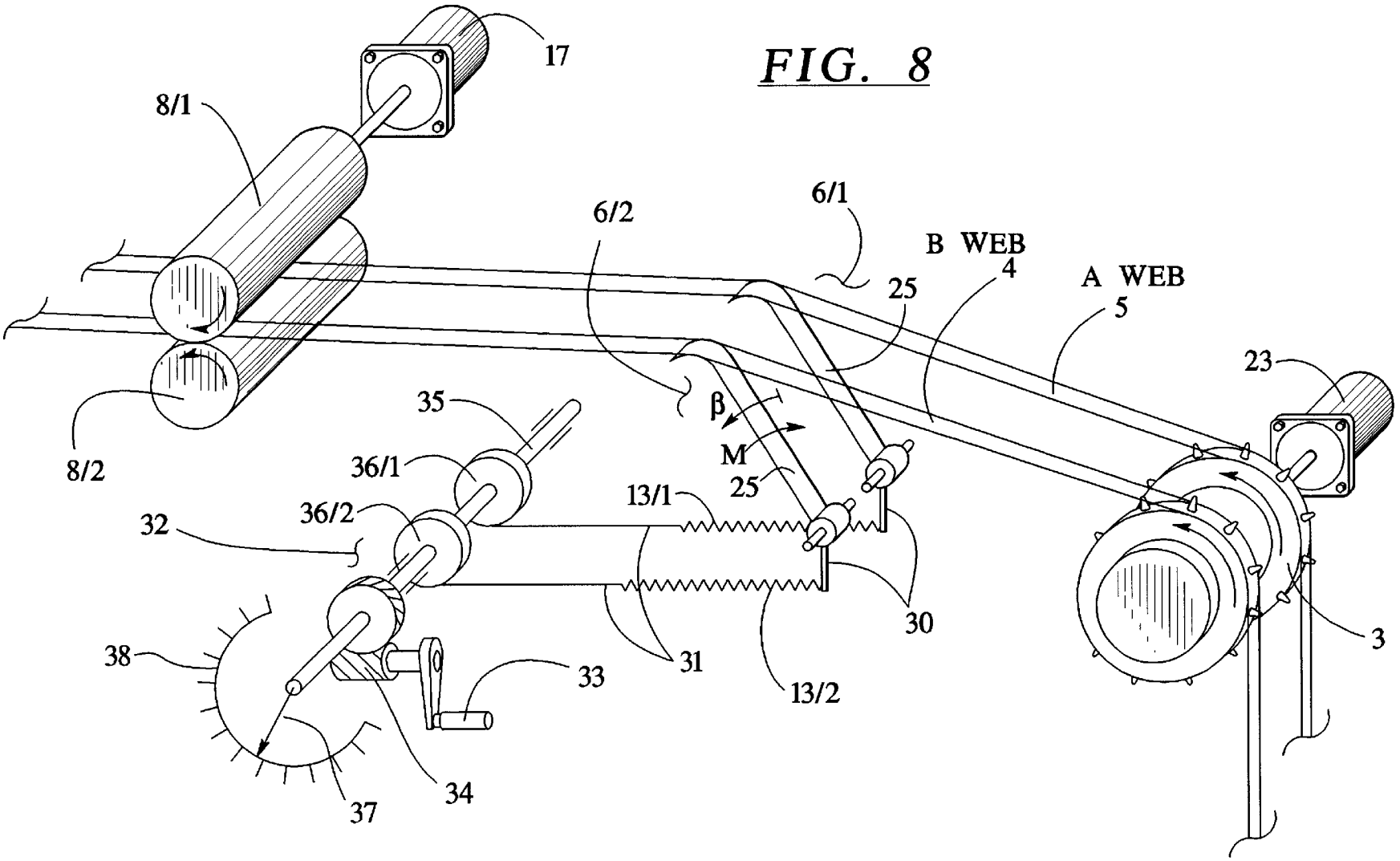
FIGS. 8–12 are schematic illustrations of loop tractor configurations with adjustable excursion force and different force characteristics.

Dependent on the desired, different function options of the control means that are described later, various embodiments of the loop tractor shown in FIGS. 8–12 can be utilized:

Basic Structure (FIG. 8)

The side-by-side loop tractors 6/1, 6/2 are deflected with a respectively separate spring 13/1, 13/2 that engage at excursion elements 25 via link levers 30. The initial angular position of the link levers 30 influences the modification of the restoring moment (M) of the loop tractors with the loop tractor angle (β). At the other side, the respective spring 13/1, 13/2 is in communication with a cable 31. This cable 31 is attached to a roll-up means 32. A shaft 35 is turned here via a hand crank 33 and worm gear pair 34. The roll-up means can work continuously or only in a defined angular range. The two cable rollers 36/1, 36/2 as well as a pointer 37 of a force adjustment scale 38 are seated on this shaft 35.

Due to the specific design of the roll-up means 32, the restoring moment between the two loop tractors 6/1, 6/2 can be adjusted.

Symmetrical Embodiment

Figure 9A:
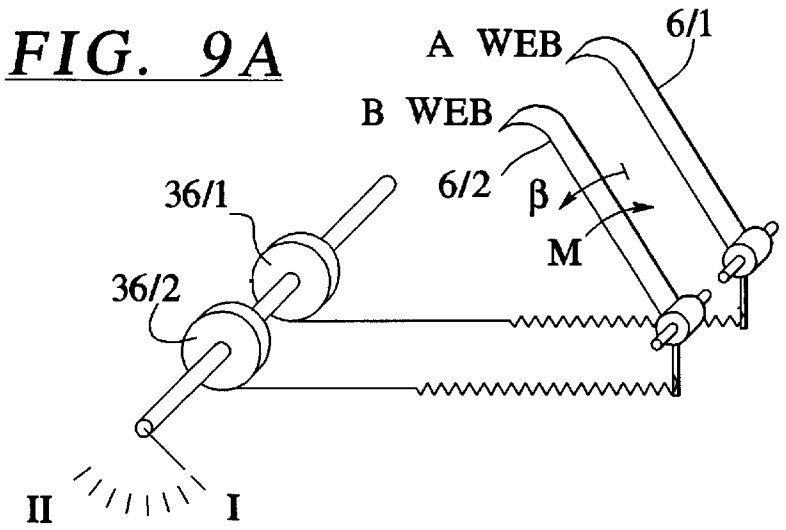
Figure 9B:
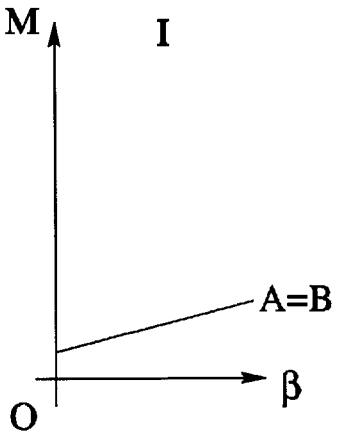
Figure 9C:
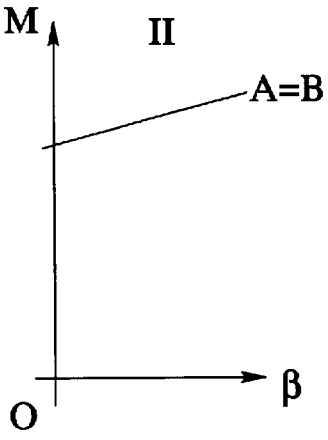

Given a symmetrical embodiment according to FIG. 9*a*, the generated restoring moments M of the two loop tractors 6/1, 6/2 are the same in both webs A, B. This is advantageous when the paper webs have the same structure and there is no tendency that one web basically tends toward a larger loop than the other. The characteristics (abscissa β, ordinate M) of the restoring moments additionally shown are the same in each of the adjustment positions (I, II of the scale in FIGS. 9*b* and 9*c*) for both loop tractors 6/1, 6/2. Link levers can also be utilized instead of the cable rollers 36/1, 36/2.

Asymmetrical Embodiments

Asymmetrical embodiments are advantageous when the webs behave differently with predictable direction. This can be opposed here with different forces and force characteristics.

Lead of a Page

When the cable 31 (FIG. 8) is shortened at only one loop tractor, a difference in the two moment characteristics arises. Given an otherwise symmetrical roll-up behavior, this difference remains the same over all force settings. Given asymmetrical arrangements, and intentional offset between loop tractor A and B is generated with the cable length.

Different Roll-Up Behavior

Figure 10A:
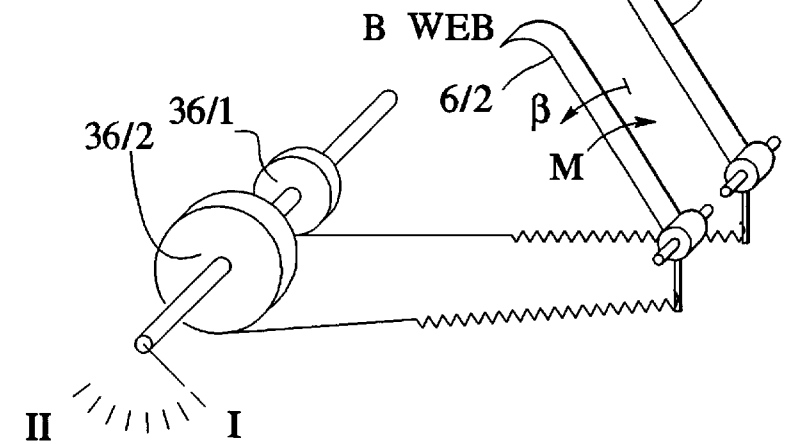
Figure 10B:
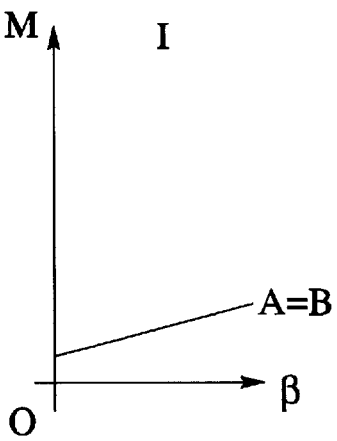
Figure 10C:
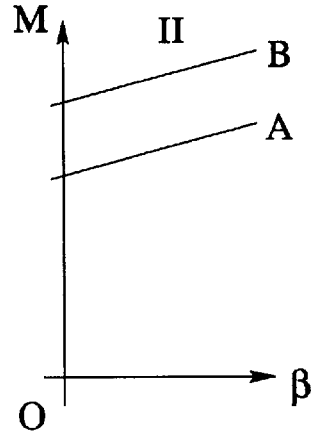

Different Diameters of the Cable Rollers (FIG. 10*a*)

What is achieved with this arrangement is that a difference of the two moment characteristics changes linearly via the adjustment. The special case is shown wherein the two characteristics coincide at the adjustment position I in FIG. 10*b*. This effect can also be achieved with link levers of different lengths given a non-racing adjustment.

Figure 11A:
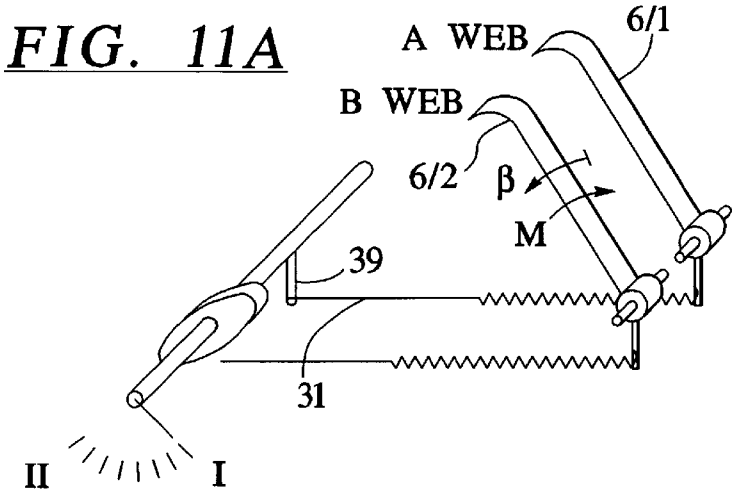
Figure 11B:
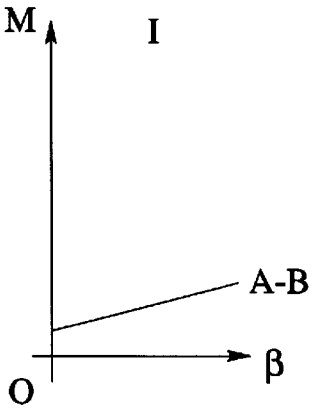
Figure 11C:
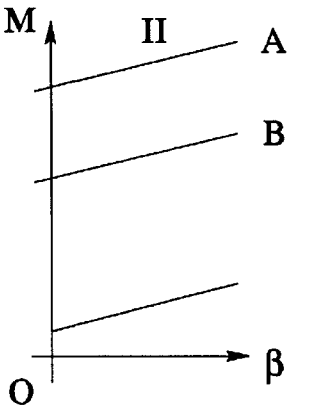

Other Forms of Roll-Up Cams (FIGS. 11*a, b* and *c*, 12*a, b* and *c*)

When the adjustment of the moment characteristics or the difference between the moment characteristics should change non-linearly, different roll-up cams can be utilized. These are generally different cam shapes, with the special cases: eccentric, ellipse, helix.

Lever Articulations (FIGS. 11*a, b* and *c*, A-page)

Levers 39 to which the cable 31 is hinged can also be utilized instead of the cable rollers 36. It is possible to achieve different and non-linear adjustment characteristics on the basis of different correction angles.

Figure 12A:
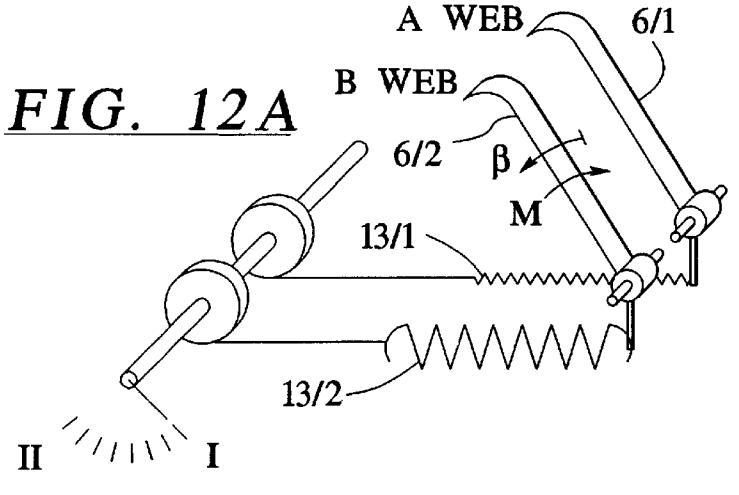
Figure 12B:
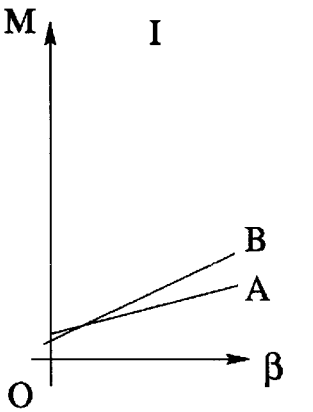
Figure 12C:
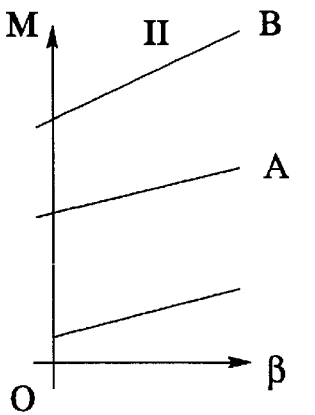

Different Spring Characteristic (FIGS. 12*a, b* and *c*)

The slopes of the moment characteristics is differently configured due to different spring ratings of the springs 13/1, 13/2. The difference in the slop of the characteristic remains the same over different force settings. Springs having different prestress act like the variation of the cable length between the A-side and B-side.

Combinations

Combinations of the embodiments that have been presented are also possible. Deviating, thus, from the previously described adjustment means, two adjustment means can also be utilized for the adjustment of the two loop tractor characteristics. With separate adjustment means for the loop tractors, these can be adjusted independently of one another. With a composite adjustment means composed, for example, of two generally acting devices, thus, the force level of the two sides can be set in the same sense, on the one hand, and, on the other hand, the force difference between the two loop tractors.

Motor Adjustment

The mechanical adjustment via cranks and worm gear pairs can also ensue automatically (with, for example, an electric motor). This is also true of the separate adjustment.

The printer itself can determine the rated values for the automatic adjustment of the loop tractor forces. The setting of the loop tractor forces can ensue once upon insertion of the paper or can additionally ensue dynamically during operation. The relevant measured quantities therefor are: paper width, position of the loop tractors, position of the web edge following the loop tractor or the slippage of the webs in the following fixing station.

Function of the Regulation

Figure 7:
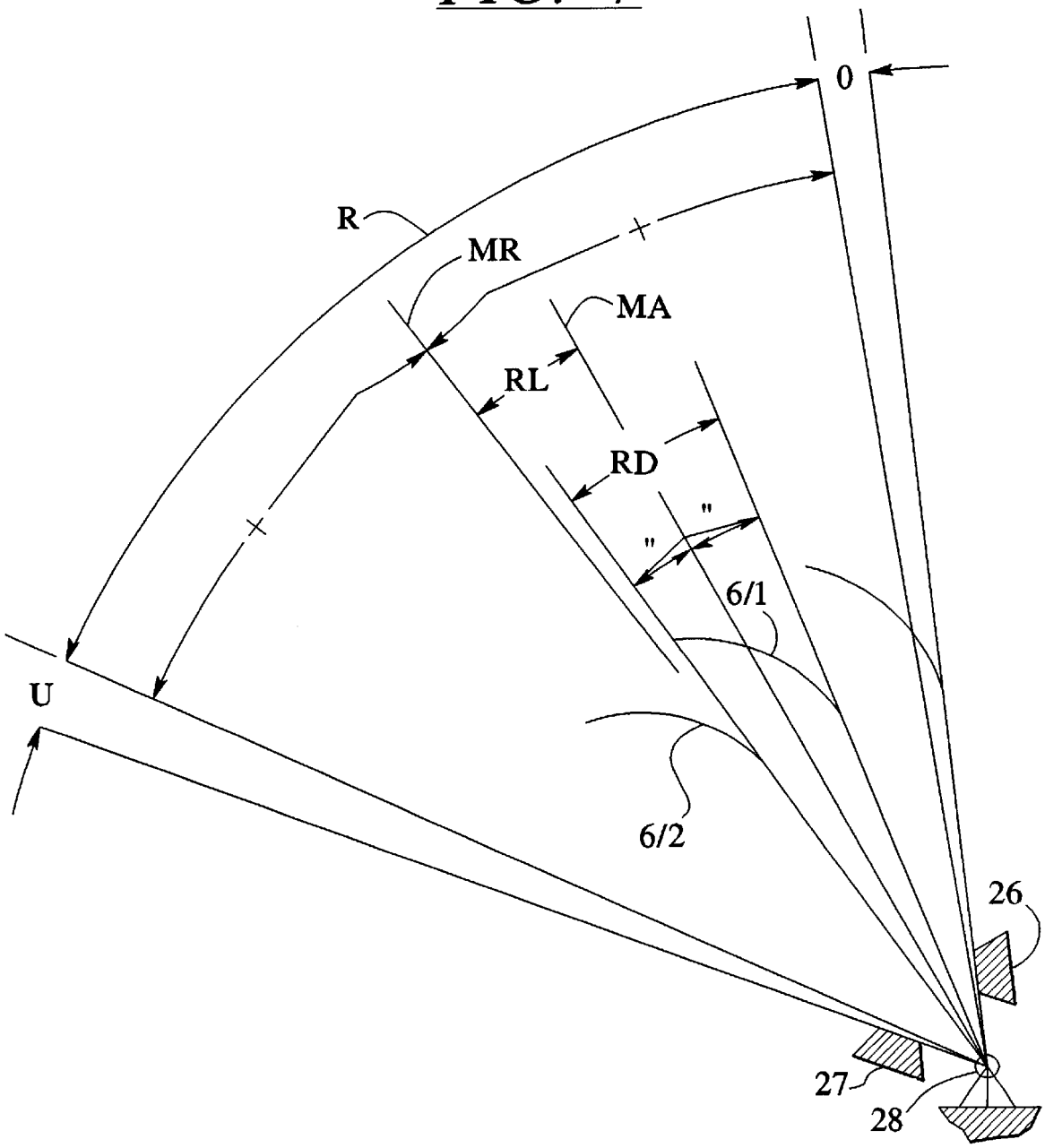
FIG. 7 is a schematic illustration of the function of a loop tractor employed as a band store.

The function of the regulation is explained below with reference to the various positions of the loop tractors that are shown in FIG. 7 and sensed via the rotational angle sensors 12, whereby each loop tractor comprises a deflection element 25 pivotable around a rotational axis together with appertaining deflection springs 13/1, 13/2 (FIG. 8). Each of the loop tractors 6/1 and 6/2 thereby swivels around a rotational axis 28 between an upper mechanical detent 26 and a lower mechanical detent 27. Its current position is dependent on the loop length released by the paper webs and, thus, on the content of the band store or, respectively, on the stored band length. Thereby denoting are: O, the upper error region; R, the working region; U, the lower error region; RL, the repetitive error of the loop length regulation; MA, the average of the current loop tractor position; and Mr, the middle of the working region of the loop tractor.

Loop Length Regulation

The manipulated variable is regulated to its rated value by varying the speed of the fixing drum 8/1 via the control electronics 20. The average MA (FIG. 7) of the current loop tractor positions 6/1, 6/2 is the manipulated variable. The rated value is, for example, the middle MR of the working region of the loop tractors. The repetitive error of the loop length regulation RL is thus regulated toward zero.

This regulation differs as a result thereof from the drive speed regulation discussed initially in conjunction with two friction drives in series. The present regulation means does not regulate to a parameter of one web but to the status of the webs relative to one another.

Loop Difference Regulation

The difference of the loop tractor positions in the A-web 6/1 and the B-web 6/2 (repetitive error RD of the loop difference regulation (FIG. 7)) is regulated toward zero with the loop difference regulation. Given employment of a purely proportional control algorithm, a lasting repetitive error can remain. This is potentially desired since the support of the regulation by the loop tractors can thereby ensue.

The two underpressure brakes 7/1, 7/2 serve as actuators for the loop difference regulation. The loop difference regulation supplies the rated values for the lower-ranking pressure regulation of the respective underpressure brake via the valves 16/1, 16/2. As a result thereof, the slippage of the A- and B-webs in the fixing gap 9 between the rollers 8/1 and 8/2 is varied relative to one another.

The braking forces are varied proceeding from, for example, standard settings or, respectively, standard values for the underpressure that are stored in a memory of the control electronics 20 in the form of tables. Dependent on the direction and size of the difference of the loop tractor positions, the braking force is increased proportionally in the one web and reduced proportionally in the other web.

The symmetrical variation of braking force described here can also ensue in some other way; for example, proceeding from low braking forces for both webs, the braking force can be increased only in the web in which a relatively greater slippage is to be achieved.

Modifications and Expansions of the Regulation

Isodirectional change of the paper braking force of the underpressure brake is one modification. Up to now, the underpressure brakes 7/1, 7/2 were used by the loop difference regulation in order to vary the braking forces transmitted onto the paper webs 4, 5 web-specific and oppositely directed. However, the underpressure brakes 7/1, 7/2 can also be used for the loop length regulation. When, for example, the two paper webs 4, 5 exhibit extremely high slippage in the fixing drum gap 9, the standard starting values for the rated underpressure can be isodirectionally reduced on both webs by the loop length regulation. This can ensue manually or automatically by calling reduced standard values from the table memory of the control electronics 20.

Regulation of the Pressing Power

The pressing power is the force with which the pressure roller 8/2 is pressed against the fixing drum 8/1. It greatly influences the relationship between the paper tensing force and the slippage of the webs in the fixing drum gap 9. A greater slippage of the paper webs 4, 5 is achieved by lower pressing power given the same paper tensing force.

In order to preclude tearing of the paper, the tensile forces in the paper webs must be limited. The forces limited in this way at the underpressure brake and at the loop tractor may, given papers having extremely low slip behavior, not be in the position to govern the loop differences. The loop tractors move farther and farther apart. In order to achieve a greater slip difference with the available difference in force, it can be necessary to reduce the pressing power of the pressure roller against the fixing drum.

When, for example, the loop difference regulation in the described case is not in the position of compensating the loop difference with allowable tensing forces, it reduces the pressing power via the pivot mechanism 18 of the pressure roller by turning the cam via the motor 19. By contrast, the pressing power is increased given occurrence of high slip values. The pressing power, however, cannot be arbitrarily reduced since the fixing is no longer adequate given too low a pressing power. A high pressing power has a beneficial influence on the fixing of the printing format.

Synchronization Stop

When the two paper webs 4, 5 can no longer be kept within predetermined limits by the mechanical and control-oriented measures for varying the slippage, a synchronization stop is automatically generated.

This, for example, is the case when the regulation of the loop differences can no longer limit the loop difference even given minimal pressing power of the pressure roller. One loop tractor then swivels into an error region that is recognized by the corresponding angle sensor 12 and reported to the control electronics 20. This stops the printer via the device controller. The conditions therefor are independently recognized by the printer by logical evaluation of the sensor signals and can be defined by inputting and storing corresponding limit values or, respectively, conditions in a memory area of the control electronics 20. The printer stops automatically in the synchronization stop; both loop tractors are pulled back into the parallel starting position, for example automatically by calling the corresponding standard start values or by displacing and aligning the webs relative to one another manually with the assistance of the alignment line 2 in the transfer printing region; and the printer automatically restarts. This procedure can cyclically repeat. It can be beneficial to employ reduced values instead of employing standard settings in the restart following a synchronization stop. When a paper exhibits such slippage that a synchronization stop occurs once, it is probable that this will cyclically repeat. The pressing power should already be reduced at the restart in order to then keep the printing cycle as long as possible. Dependent on the device design, the cyclical repetition of the synchronization stop can replace the entire loop difference regulation.

Varying the Lubrication of the Fixing Drum

The lubrication of the fixing drum with parting oil that is standard in thermal fixing stations in order to avoid offset print effects due to toner adhering to the fixing drum influences the friction relationships between the paper web and the fixing drum in the fixing gap. Greater lubrication produces higher slip values given unmodified force relationships. When a paper is processed and the slip behavior thereof lies beyond the processable range with the start parameters of the printer, additional influence can be taken via the lubrication of the fixing drum.

The oiling of the fixing drum is usually utilized for improving the toner release properties of the oiled drum. Oiling stations whose amount of lubrication can be controlled are used therefor, as is standard in electrophotography. It is possible to control the oil flow in such an oiling station via the control electronics 20 and to thus influence the slippage.

Progressive Loop Tractor Force

In the arrangement described up to now, the braking or, respectively, tensing forces in the paper webs are only actively generated by the underpressure brake 7. In addition to the underpressure brake, however, there is also the possibility of introducing tensing forces into the paper webs with the loop tractors.

The function of the underpressure brake and total loop difference regulation can be supported or completely taken over by a specific arrangement of the loop tractor mechanism.

Let this arrangement be called progressive loop tractor force here.

The control algorithm of the loop difference regulation fundamentally contains the function that a relatively higher tensing force is generated in the web whose loop tractor resides relatively lower.

Given the progressive loop tractor force, the spring mechanism of the loop tractors is designed such that the loop tractor that is pulled relatively deeper down introduces a relatively higher tensing force into the respective paper web than the other. This force difference must increase with increasing angle difference.

This demand can be met, for example, by different spring arrangements as described in conjunction with FIGS. 8 through 12.

Isodirectional Change of the Paper Tensing Force with the Loop Tractors

The loop tractor can assume further functions in addition to its control-oriented function. By deflecting the web around the loop tractor, this stabilizes and steers further running of the web. Respectively adapted paper traction forces are required here for different web qualities and web widths. This adaptation can ensue via a manual adjustment mechanism, as was likewise described in conjunction with FIGS. 8 through 12.

When the loop difference regulation is supported or replaced by a progressive loop tractor force, the loop length regulation can isodirectionally vary the paper tensing forces with the loop tractors. This can replace the manual setting. Further, the possibilities of the regulation can thus be expanded.

When, for example, the slip of the two paper webs is inadmissibly high at the fixing drum, the tensing force can be isodirectionally reduced in both paper webs. This enables the loop length regulation via a shift of the rated value of the regulation. (It is standard for the rated value to lie in the middle of the working range of the loop tractors).

Mechanical Actuation of the Underpressure Brake

The loop difference regulation can also be mechanically realized. For example, the actuators of the underpressure brakes 7/1, 7/2 (for example, underpressure valves 16/1, 16/2) are thereby mechanically coupled with the loop tractors. The control relationships and proportionalities can then also be realized, for example, via rodding arrangements.

A Fixed Loop Tractor

The loop length regulation regulates the average MA of the two current loop tractor positions (FIG. 7) to its rated value. The allowable controlled difference for the loop difference regulation is maximized by this procedure. When this is not urgent, the loop length regulation can also regulate to only one of the loop tractors 6/1, 6/2. In the simplest arrangement, for example, this regulation can be a two-point control.

As already described, the second loop tractor is then regulated relative to the first.

Processing a Wide Paper Web

The printer device in which the inventive control means is employed has a basic structure as disclosed by the published application WO 94/27193. The printer device can thus be operated both in two-web as well as in one-web mode. This both with webs having the widths the same as those of the two-web mode as well as with a web width across the entire width of the two, individual paper webs.

For the participating units, this means, in detail:

Positive Drive

The conveyor caterpillars for the paper conveying in the transfer printing region can be matched to the respective web width. This both for two as well as for one web.

Loop Tractors

The two loop tractors are mechanically coupled in one-web mode and act like a continuous loop tractor. As a result of the coupling, the current positions of the loop tractors coincide. Their average value is thus also identical to their current position. This coupling can be monitored by a sensor, for example for reasons of dependability.

Underpressure Brakes

The effective width of the underpressure brakes can be set via a width adjustment, as is standard in single-web electrographic printer devices that are suitable for printing different band widths. A continuously wide web can also operated with it.

Fixing Station

Neither the fixing drum nor the pressure roller are divided in the illustrated thermal fixing means. This also applies given the employment of a flash fixing means or of a projector fixing means. Such fixing stations are thus suitable for single-web mode which is unmodified. The return, the turning means and the loop of the return are not traversed in single-web mode.

Processing Two Independent Paper Webs

The invention was described with reference to a web configuration in the printer wherein the recording medium is first printed on the front side, then turned over and returned and then printed on its back side. Without modification of its structure, the regulation is also in the position, analogously, of regulating the synchronous paper running of two separate paper webs that traverse the entire printer in parallel according to the published publication WO 94/27193.

Self-Learning Control Algorithm

The reactions of a rigid control are more or less appropriate dependent on the nature of the printing material. Self-learning controls that optimize their control behavior dependent on the printing material and environmental conditions are advantageous here. To this end, the parameters of printing material and environmental conditions can be input into the control means via an input device or the control means independently acquires the parameters via corresponding sensors. These, for example, can be standard sensors for sensing the thickness of the printing material, for acquiring its surface structure, the ambient temperature, the humidity, etc. It is also possible to identify the printing material with, for example, a bar code which may be read.

Error Recognition

Data of the current operating condition are measured at various locations of the printer for the loop regulation. For example, data about the slip behavior of the paper, about content and rate of change of the paper store, etc., are thus available.

Errors of the machine can be recognized and handled beyond previous possibilities via limit value and plausibility checks as well as via combinatorial error analyses of parameters with the assistance of a monitoring arrangement allocated to the regulating means or the device controller. The monitoring function can also be assumed by the control electronics itself. A person skilled in the art is familiar with how such a monitoring arrangement is to be constructed in circuit-oriented terms.

Further Possibility for Loop Difference Regulation

Figure 13:
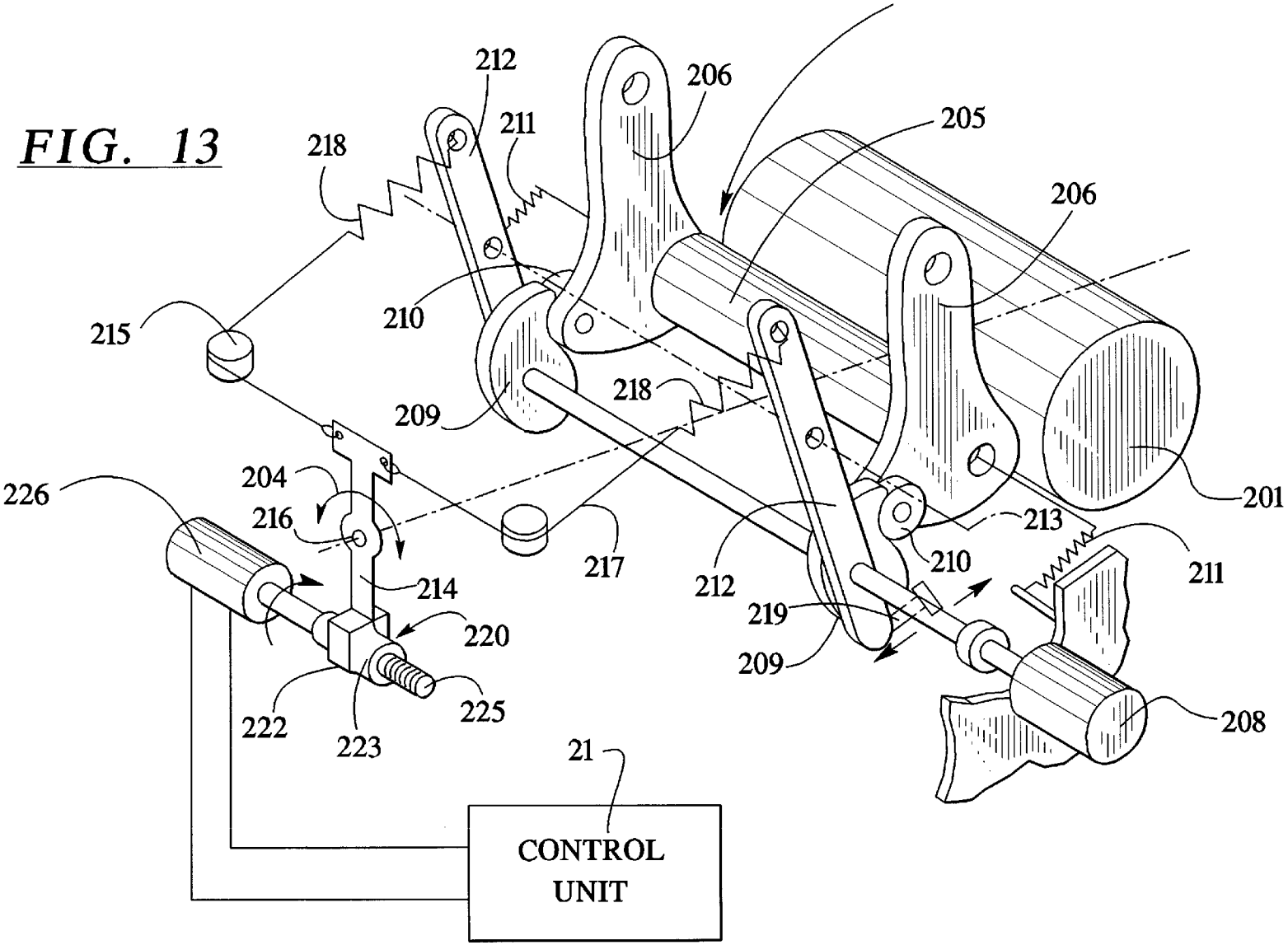
FIG. 13 is a schematic illustration of a pressing power adjustment mechanism for the pressure roller of a fixing station.

As explained in conjunction with the loop difference regulation, the two underpressure brakes 7/1 and 7/2 serve as actuators for introducing the web-specific tensing forces into the respective paper web A or B. It has now turned out that an arrangement for page regulation of the paper running (edge regulation) of a paper web that is basically known from U.S. Pat. 5,323,944 and shown in FIG. 13 is especially well-suited as an actuator for introducing the web-specific tensing forces into the respective paper web A or B. The arrangement can be employed as a sole actuator or can be employed in combination with another actuator that influences the web-specific tensing forces, for example the underpressure brakes 7/1 and 7/2. In a combination, it is especially suited for fine control.

As shown in FIG. 13, the arrangement acts on the fixing drum 201 that is constructed in conformity with the fixing drum 8/1 of FIG. 6. A pressure roller 205 corresponding to the pressure roller 8/2 of FIG. 6 can be swivelled in against and away from the fixing drum. The pressure roller 205 is seated on two lateral bearing elements 206. The bearing elements 206 are in turn arranged in the frame of the printer device swivellable around a stationary rotational axis. Two eccentric disks 209 that can be turned via an electric motor 208 and that lie against guide projections 210 (rotatable rollers) of the bearing elements 206 are provided for swivelling the pressure roller in against and away from the fixing drum 201 that acts as a counter-roller. Two restoring springs 211 laterally engaging at the bearing elements 206 pull the bearing elements 206 against the eccentric disks 209 via the guide projections 210.

The eccentric disks 209 are respectively arranged in an end of a lever-like rocker 212. These rockers are seated rotatable around a stationary rocker axis 213 parallel to the pressure roller axis. Spring elements 218 in the form of coil springs are hooked to a side of the rockers 212 lying opposite the eccentric disk. The other end of the coil springs 218 is connected to a cable or a chain 217 that is respectively guided around a stationary deflection roller 215. The free cable or chain ends are secured to a first end of an adjusting lever 214 pivotable around a symmetry axis 216. The effective direction of the spring elements 218 directed perpendicularly to the pressure roller axis is deflected by the force deflection means fashioned as a cable or chain 217 and as a deflection roller 215. The effective direction then corresponds to the swivelling direction 204 of the adjusting lever 214 indicated by an arrow. This swivelling direction 204 is directed parallel to the pressure roller axis. As a result of this arrangement of the spring elements 218, these exert a tensile force on the rockers 212 that is converted such by the rockers 212 in a pressing power that the pressure roller 205 is pressed against the fixing drum 201. For limiting the range of swing of the rockers 212, adjustable detents 219 are arranged in the bearing region of the eccentric disks 209.

The spring power of the spring elements 218 is noticeably greater than the spring power of the restoring springs 211 at the pressure roller 205. When pressed against the pressure roller 205, the rockers 212 are pivoted away from the detents 219. According to their rotated position, the eccentric disks 209 press the pressure roller 205 against the fixing drum 201. The pressing power is thereby essentially defined by the spring power of the spring elements 218 in combination with the geometrical structure of the rocker 212 and the rotated position of the eccentric disk 209.

The actuator 220 is composed of a spindle 225 directed in the effective direction of the spring elements 218, of a spindle nut 223 and of a spindle nut claw 222. The spindle 225 is coupled to a stepping motor 226 that can be controlled proceeding from the control unit 21 (see FIG. 6). Upon rotation of the spindle 225, the spindle nut 223 is displaced in longitudinal direction of the spindle 225 and, dependent on the excursion of the pivoted lever 214, a corresponding pressing power is thus exerted onto the paper webs A or B (not shown here) guided between the fixing drum 201 and the pressure roller 205. When the one spring 218 is tensed by pivoting the pivoted lever 214, the pressing power is increased in, for example, the region of the B-web and is reduced in the region of the A-web due to relaxation of the corresponding, other spring 218. As a result, the slippage is increased in the A-web and reduced in the region of the B-web.

A difference in slip of the A-web and B-web can already be generated as a result of slightly unequal pressing powers with the assistance of the pressing power adjustment mechanism. The A-web is thereby oppositely stressed by the same pressing power by which the B-web is relieved.

Particularly given paper grades that have larger holes or that, due to their quality, cannot be regulated even with maximally possible difference in underpressure, the opposed adjustment of the pressing powers is an important alternative.

Modifications and Expansion of the Regulation

The use of the pressing power adjustment mechanism is to be preferred over the above-described regulation of the pressing power since the influence on the difference in slip is greater due to opposed adjustment of the forces.

In particular, the negative influence on the fixing quality is lower since the opposed reduction of the pressing power of the A-web turns out lower than the simultaneous reduction of pressing power on both webs when the pivoted cam 18 (FIG. 6) is pivoted away. When the pivoted cam 18 is pivoted away, the slip of both paper webs is increased and effects a difference in slip only indirectly via the use of the underpressure control. A web-specific variation of the pressing powers, by contrast, is possible with the assistance of the pressing power adjustment mechanism.

Papers with large hole areas and other critical papers (recycled paper, etc.) potentially require frequent synchronization stops solely with the underpressure regulation without employment of the pressing power adjustment mechanism. In view of the printer performance, however, such stops are to be avoided insofar as possible.

The adjustment of the loop tractor force requires an operator intervention. Each such intervention should be avoided if at all possible, this being promoted by the use of the web specific pressing power adjustment.

Figure 14:
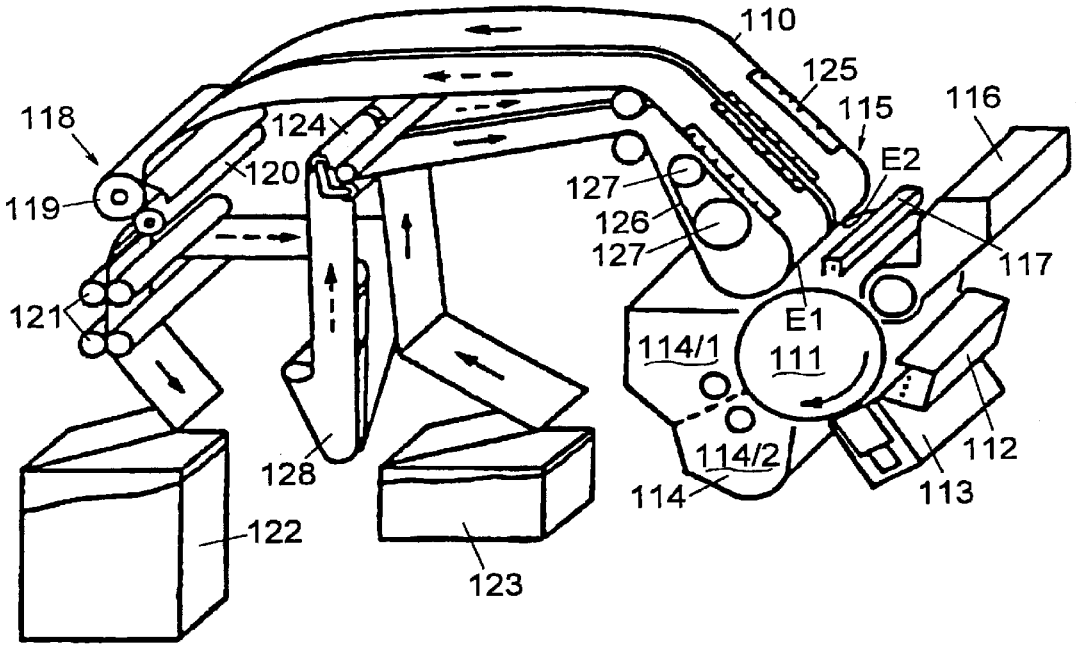
FIG. 14 is a perspective view of an electrographic printer device for printing web-shaped recording media in duplex mode.

The use of the opposed pressing power regulation on the one hand and of the underpressure regulation or, respectively, loop tractor force on the other hand can basically be arbitrarily combined. With which papers and beginning at which point the respective regulation should be utilized independent of material and function An example of an electrographic printer device is shown in FIG. 14, including an intermediate carrier 111, a charging device 112, a character generator 113, a developer station 114, a transfer printing station 115, a cleaning station 116 and a discharging means 117. A fixing station 118 follows the transfer printing station 115 and has a heated fixing drum 119, and a pressure roller 120. A stacker 122 for the recording medium 110 is provided with delivery rollers 124. A conveyor 125 moves the recording medium through the printer and includes drive rollers 127 and a deflector 128.

Although other modifications and changes may be suggested by those skilled in the art, it is the intention of the inventor to embody within the patent warranted hereon all changes and modifications as reasonably and properly come within the scope of his contribution to the art.

We claim:

1. A device for transporting recording medium webs in an electrographic printer device, comprising:

a drive means for positively driving the recording medium webs in common, a first function region through which the recording medium webs are passed in parallel side-by-side, a second function region through which the recording medium webs are then supplied in parallel side-by-side, a friction drive in common with said first function region and said second function region, a surface speed of a surface of the friction drive driving the recording medium webs is undifferentiated for the recording medium webs, a regulating means for controlling running of the recording medium webs by slippage of the friction drive of each individual one of said recording medium webs, said regulating means including:

an acquisition means for acquiring a relative displacement in a conveying direction of the recording medium webs relative to one another in a region between said first and second function regions;

adjustment means for adjusting the slippage of each individual one of said recording medium webs in the friction drive of the second function region;

control means for compensating the relative displacement that are coupled to the acquisition means and the adjustment means;

at least one band store for storing the recording medium webs, and a sensor acquiring a filling condition of said at least one band store.

2. A device according to claim 1, wherein said acquisition means includes loop tractors with sensors which acquire rotated positions of said loop tractors, said loop tractors being allocated to the recording medium webs.

3. A device according to claim 2, further comprising: loop-forming units which deflect the recording medium webs with an adjustable deflection force dependent on a rotated position of said loop-forming units.

4. A device according to claim 3, wherein said loop-forming units include deflection elements with appertaining deflection springs that engage at the recording medium webs and are pivotable around a rotational axis, the deflection springs being coupled to a tensing means for setting spring prestress.

5. A device according to claim 2, wherein said at least one band store includes a plurality of band stores and wherein said regulating means includes a first function group that controls content of the band stores that influences content of the band stores of the recording medium webs in a same sense, and a second function group that controls a difference of the contents of the band stores that, oppositely influences the contents of the band stores.

6. A device according to claim 2, further comprising: sensors sensing markings on the recording medium webs.

7. A device according to claim 2, further comprising:

a brake arranged preceding the friction drive in a recording medium conveying direction; and means for regulating braking power on the recording medium web.

8. A device according to claim 7, wherein said brake includes a glide surface with suction openings accepting the recording medium webs, said suction openings being allocated to each of the recording medium webs, said glide surface being coupled to a means for generating an adjustable underpressure.

9. A device according to claim 1, wherein said electrographic printer device includes a transfer printing region, wherein said first function region being a transfer printing station and said second function region being a fixing station.

10. A device according to claim 1, wherein said second function region includes a fixing drum with an appertaining pressure roller that presses the recording medium webs against the fixing drum, at least one of said fixing drum and said pressure roller being heated and motor-driven.

11. A device according to claim 1, further comprising:

a controllable device for setting pressing power on the recording medium webs.

12. A device according to claim 11, wherein said friction drive includes a drive roller, and further comprising:

a movably seated pressure roller pressing the recording medium webs against said drive roller of the friction drive and a force adjustment mechanism coupled to said movably seated pressure roller to web-specifically vary pressing power of said movably seated pressure roller in a region of the recording medium webs.

13. A device according to claim 12, further comprising:

spring elements, a setting means coupled to said spring elements, said setting means having a zero position, and respective lateral bearing element of the pressure roller coupled to said spring elements such that said lateral bearing elements press the pressure roller in force-compensating fashion against said drive roller in the zero position of the setting means, transmission of force to the bearing elements that is dependent on a setting position then ensues by excursion of the setting means out of the zero position.

14. A device according to claim 10, further comprising:

means for controlling variation of coefficient of friction of said fixing drum and said pressure roller.

15. A device according to claim 14, wherein said means for controlling the variation of the coefficient of friction includes means for controlling delivery of parting oil.

16. A device according to claim 9, wherein said fixing station includes a flash fixing means.

17. A device according to claim 9, wherein said fixing station includes a projector fixing means.

18. A device according to claim 1, further comprising:

means allocated to the regulating means by which a synchronization stop is triggered given upward transgression of a predetermined range of control, during which synchronization stop a synchronization of parallel running of the recording medium webs can ensue by relative displacement of the recording medium webs into a synchronous position.

19. An electrographic printer device for single-sided or both-sided printing of a band-shaped recording medium, comprising:

an intermediate carrier for generating toner images allocated to at least one of a front side and a back side of the recording medium;

a transfer printing station having a first transfer printing region for transfer of a first toner image onto a front side region of the recording medium and a second transfer printing region lying adjacent said first transfer printing region for transfer of a further toner image onto the front side region or a back side region of the recording medium, as well as a conveyor means that positively drives the recording medium in the first and second transfer printing regions;

a turning means for turning the recording medium over;

a fixing station following the transfer printing station in a conveying direction of the recording medium having an allocated friction drive for the recording medium, the recording medium, in a first recording medium web proceeding from a delivery region, being conducted via the first transfer printing region to the fixing station and, turned over by the turning means as needed for printing the back side region, being conducted therefrom to the second transfer printing region and being conducted again through the fixing station in a second recording medium web and a drive means for positively driving the recording medium webs in common, a first function region through which the recording medium webs are passed in parallel side-by-side, a second function region through which the recording medium webs are then supplied in parallel side-by-side, a friction drive in common with said first function region and said second function region, a surface speed of a surface of the friction drive driving the recording medium webs is undifferentiated for the recording medium webs, a regulating means for controlling running of the recording medium webs by slippage of the friction drive of each individual recording medium web, said regulating means including:

an acquisition means for acquiring a relative displacement in a conveying direction of the recording medium webs relative to one another in a region between said first and second function regions;

adjustment means for adjusting the slippage of each individual recording medium web in the friction drive of the second function region;

control means for compensating the relative displacement that are coupled to the acquisition means and the adjustment means;

at least one band store for storing the recording medium, and a sensor acquiring a filling condition of said at least one band store.

20. A method for transporting recording medium webs in an electrographic printer device, comprising the steps of:

positively driving the recording medium webs in common via a drive means, passing the recording medium webs through a first function region in parallel side-by-side, supplying the recording medium webs in parallel side-by-side to a second function region with a common friction drive, surface speed of a surface of the friction drive driving the recording medium webs cannot be differentiated for the recording medium webs, acquiring a relative displacement in a conveying direction of the recording medium webs relative to one another in a region between a transfer printing region and a fixing station;

controlling slippage of the friction drive in the conveying direction of each individual recording medium web until the relative displacement falls below a prescribable value.

* * * * *